US006889522B2

(12) United States Patent
Prible et al.

(10) Patent No.: US 6,889,522 B2
(45) Date of Patent: May 10, 2005

(54) LNG FLOATING PRODUCTION, STORAGE, AND OFFLOADING SCHEME

(75) Inventors: Donald Prible, Spring, TX (US); Robert R. Huebel, Sugar Land, TX (US); Jorge H. Foglietta, Missouri City, TX (US)

(73) Assignee: ABB Lummus Global, Randall Gas Technologies, Houston, TX (US)

( * ) Notice: Subject to any disclaimer, the term of this patent is extended or adjusted under 35 U.S.C. 154(b) by 3 days.

(21) Appl. No.: 10/455,467

(22) Filed: Jun. 5, 2003

(65) Prior Publication Data

US 2003/0226373 A1 Dec. 11, 2003

Related U.S. Application Data

(60) Provisional application No. 60/386,375, filed on Jun. 6, 2002.

(51) Int. Cl.[7] ..... F25J 1/00; F17C 13/08

(52) U.S. Cl. ..... 62/611; 62/613; 62/53.2

(58) Field of Search ..... 62/606, 611, 612, 62/613, 53.2

(56) References Cited

U.S. PATENT DOCUMENTS

| | | | |
|---|---|---|---|
| 4,041,721 | A | 8/1977 | Kniel |
| 5,025,860 | A | 6/1991 | Mandrin |
| 5,878,814 | A | 3/1999 | Breivik et al. |
| 6,003,603 | A | 12/1999 | Breivik et al. |
| 6,250,244 | B1 | 6/2001 | Dubar et al. |
| 6,412,302 | B1 | 7/2002 | Foglietta |
| 6,530,241 | B2 | 3/2003 | Pozivil |
| 2001/0018833 | A1 | 9/2001 | Pozivil |
| 2002/0170312 | A1 | 11/2002 | Reijnen et al. |

FOREIGN PATENT DOCUMENTS

| | | | |
|---|---|---|---|
| GB | 2328197 | A | 2/1999 |

*Primary Examiner*—William C. Doerrler
(74) *Attorney, Agent, or Firm*—Bracewell & Patterson LLP

(57) ABSTRACT

A process and apparatus for exploitation and liquefaction of natural gas in offshore stranded gas reserves. Two ordinary nautical vessels are used to produce, store and unload LPG and LNG. Typical front end processing is performed on the first vessel. The treated inlet gas is transported to the second vessel where the stream goes through liquefaction and storage until it is offloaded to a transport vessel for shipment. The liquefaction process utilizes two refrigerant cycles that utilize two expanded refrigerants, at least one of which is circulated in a gas phase refrigeration cycle. The refrigerants and the inlet gas stream are transported between the two vessels by the use of piping. Electricity can be generated to provide power for the compression sections of the refrigeration cycles. Turbines, engines, or boilers from the vessels can be used for generating electricity since they are no longer needed for locomotion purposes.

22 Claims, 3 Drawing Sheets

Production of LNG Using Dual Independent Expander Refrigeration Cycles

Methane Expander
Methane Booster
Methane Recycle Compressor
Liquid Expander
LNG Product to Storage
Nitrogen Expander
Nitrogen Booster
Nitrogen Recycle Compressor
N2 Stripper

LNG FLOATING PRODUCTION, STORAGE, AND OFFLOADING SCHEME

RELATED APPLICATIONS

This application claims the benefit of a provisional application having U.S. Ser. No. 60/386,375, filed on Jun. 6, 2002, which hereby is incorporated by reference in its entirety.

BACKGROUND OF THE INVENTION

1. Technical Field of the Invention

The present invention relates to liquefied natural gas (LNG) processes. More specifically, this invention relates to offshore LNG production on nautical vessels for stranded gas reserves.

2. Description of Prior Art

Natural gas in its native form must be concentrated before it can be transported economically. The use of natural gas has increased significantly in the recent past due to its environmentally-friendly, clean burning characteristics. Burning natural gas produces less carbon dioxide than any other fossil fuel, which is important since carbon dioxide emissions have been recognized as a significant factor in causing the greenhouse effect. LNG is likely to be used more and more in densely-populated urban areas with the increased concern over environmental issues.

Abundant natural gas reserves are located all over the world. Many of these gas reserves are located offshore in places that are inaccessible by land and are considered to be stranded gas reserves. Reserves of gas are being replenished faster than oil reserves, making the use of LNG more important to the future. In liquid form, LNG occupies 600 times less space than natural gas in its gaseous phase. Since many areas of the world cannot be reached by pipelines due to technical, economic, or political reasons, using nautical vessels to transport LNG is an ideal choice.

Various schemes have been developed through the years to allow production of gas in the stranded gas reserves. Most schemes consisted of laying out a traditional LNG processing unit on the top of a dedicated floating barge or nautical vessel that was specifically built for the floating LNG process. However, most previous attempts have been cost prohibitive due to the logistics involved in such a process and the expense of a custom made nautical vessel. In addition to the high costs that average USD $180 million for a typical LNG carrier, the extremely long lead times of around three years required to manufacture a custom nautical vessel also adds considerable time and costs to the production projects.

In U.S. Pat. No. 6,003,603, Breivik teaches the use of two ships for the processing and storage of offshore natural gas. The first ship includes the field installation for gas treatment. The treated gas is then transferred in compressed form to an LNG tanker for conversion to a liquefied form, which is stored on the LNG tanker. Breivik utilizes a single refrigerant for cooling purposes within the liquefaction process, which is either in a liquid phase or a mixed phase. Once the LNG tanker storage vessels are full, the LNG tanker is disconnected from a buoy to which it is attached and sets sail. Another LNG tanker takes its place to receive the treated inlet gas for liquefaction. The LNG tanker is required to be seaworthy in order to transport the LNG product from the stranded reserves to facilities for further use.

A need exists for a more economical and efficient method of producing gas in the stranded gas reserves. It would be desirable to use existing nautical vessels, which are readily available and are not as expensive as the custom nautical vessels of the prior art. It would be advantageous for the LNG liquefaction process unit to be relatively compact to enable the process to be installed upon a nautical vessel. It would be advantageous to provide a process apparatus for exploitation and liquefaction of natural gas offshore in the stranded gas reserves through the use of existing nautical vessels.

SUMMARY OF THE INVENTION

The present invention includes a process and apparatus for exploitation and liquefaction of natural gas in offshore stranded gas reserves. The present invention uses two ordinary nautical vessels to produce, store and unload LPG and LNG, as opposed to using one that is specifically built for a floating LNG processing unit. LPG could be produced on each nautical vessel. The first vessel is referred to as an LPG/FPSO (liquefied petroleum gas/floating production, storage, and offloading) vessel. The second vessel is referred to as an LNG/FPSO vessel. The vessels can be vessels that are no longer seaworthy since the vessels will remain stationary during the entire production run. The term "seaworthy" can include vessels that have navigation certifications that have expired and are no longer allowed to transport materials through navigable waters. These non-seaworthy vessels can be towed into the location required to perform the methods described herein.

In one embodiment of the present invention, the front end processing that typically is required for LNG production is performed on the first vessel. The treated inlet gas is transported to the second vessel where the stream goes through a liquefaction process. The liquefied stream is the desired product that is stored on the second vessel until it is offloaded from an unloading facility from the second vessel to a transport vessel for further shipment. The liquefaction process utilizes two refrigerant cycles. Each refrigerant cycle preferably includes at least one expander, at least one booster compressor, at least one recycle compressor, and at least one heat exchanger. The expander and booster compressor of each cycle and the heat exchanger are preferably located on the second vessel and the recycle compression steps of each cycle are preferably located on the first vessel. The refrigerants and the treated inlet gas stream are transported between the two vessels by the use of piping. The piping can be supported between the two vessels by the use of a bridge between the two vessels.

As an alternate embodiment, electricity from generators can be produced to provide power for the compression section of each refrigerant cycle. The generators can include turbines, engines, or boilers. The generators can be installed upon the vessels or more preferably can be the generators formerly associated with supplying locomotion for the vessel upon which the generator is located. Since the vessels are no longer seaworthy, the generators are no longer needed for locomotion purposes and can be used to provide the electricity needed to run the compressor sections of the refrigerant cycles.

In this second embodiment, the inlet gas treatment section is located on the first vessel. The treated inlet gas stream can be transported from the first vessel to the second vessel through the use of submerged piping. Generators can be located on the first vessel, the second vessel, or on both. If the generator is only located on the first vessel, a cable can be used to transport needed electricity to the second vessel. If the generator is only located on the second vessel, a cable can also be used to transport needed electricity to the first vessel. If generators are located on both vessels, then cables for transporting electricity are not needed, but can be included.

In both embodiments of the present invention, the storage tanks can be membrane tanks, spherical tanks, or the like. A preferred embodiment includes vessels obtained from spent, non-seaworthy carriers that are retrofitted to remain stationary for the production of LPG and LNG. Modifications can be made to the vessels, as necessary, such as removal of tanks for needed equipment space or the addition of platforms to place equipment, if necessary.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

Figure 1:
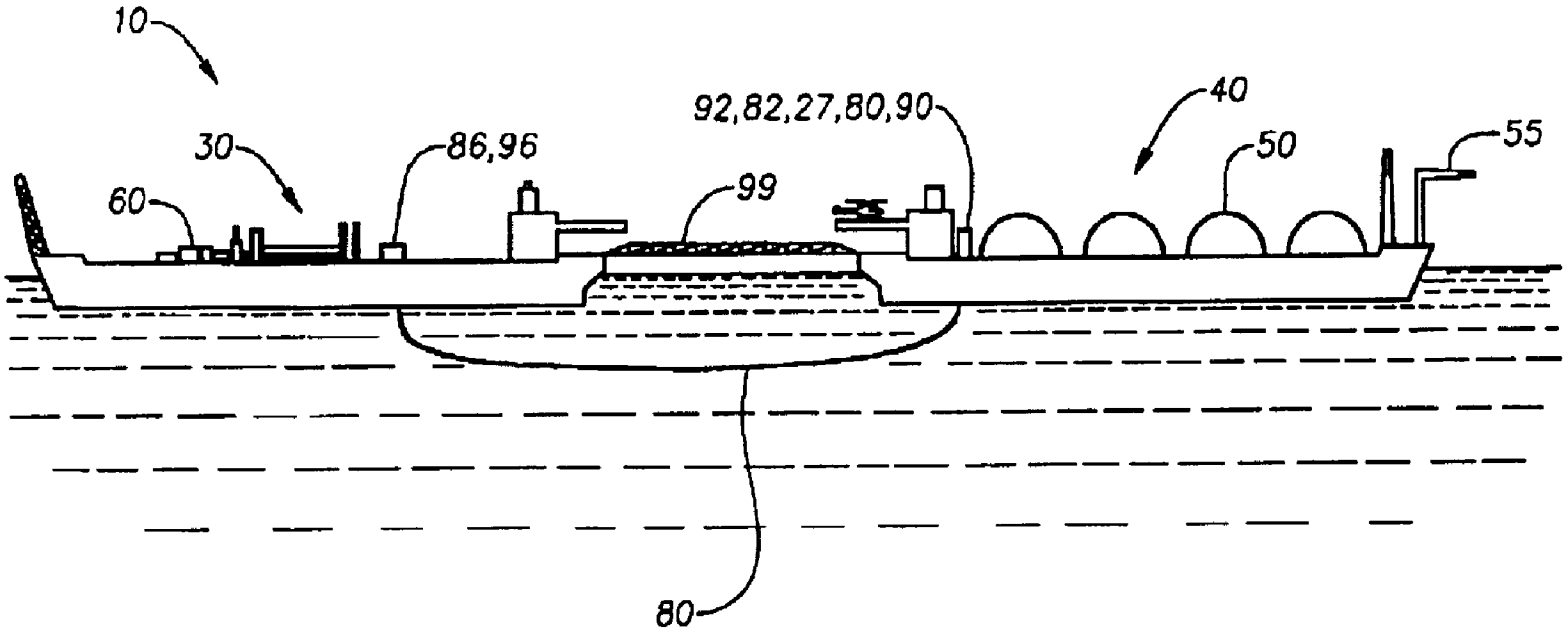
FIG. 1 is a simplified diagram of the stationary nautical vessel offshore LNG production arrangement of one embodiment of the present invention, which shows the refrigerant units being separated between the two vessels.

FIG. 1 illustrates one embodiment of the LNG exploitation and liquefaction process of the present invention 10. This embodiment uses turboexpander LNG cycle 70 within two nautical vessels 30, 40. An example turboexpander LNG cycle 70 can be found in U.S. Pat. No. 6,412,302 issued to Foglietta and is shown in greater detail in FIG. 2.

The present invention advantageously provides a system for liquefaction of natural gas offshore. In a preferred embodiment, the system preferably includes a first vessel 30 with a front end gas treating process unit 60 mounted thereon and a second vessel 40. The system preferably includes a gas phase refrigerant liquefaction process unit 70 for producing LNG. The refrigerant used in the liquefaction process 70 remains in the gas phase at all times, creating at least one gas phase refrigeration cycle 81, 91. Typical front end processing 60, such as dehydration, can also be performed on the first vessel 30. Other example front end processes 60 include contaminant removal. The treated inlet gas stream 20 is transported to the second vessel 40, where the stream 20 goes through a liquefaction process 27, which is shown in greater detail in FIG. 2. The liquefaction step 27 requires relatively reduced space and could be placed in connection to modified LNG carriers. The liquefied stream 24 is the desired product that is stored in storage tanks 50 on the second vessel 40 until it is offloaded at offloading facilities 55 to a transport vessel for further use.

Figure 2:
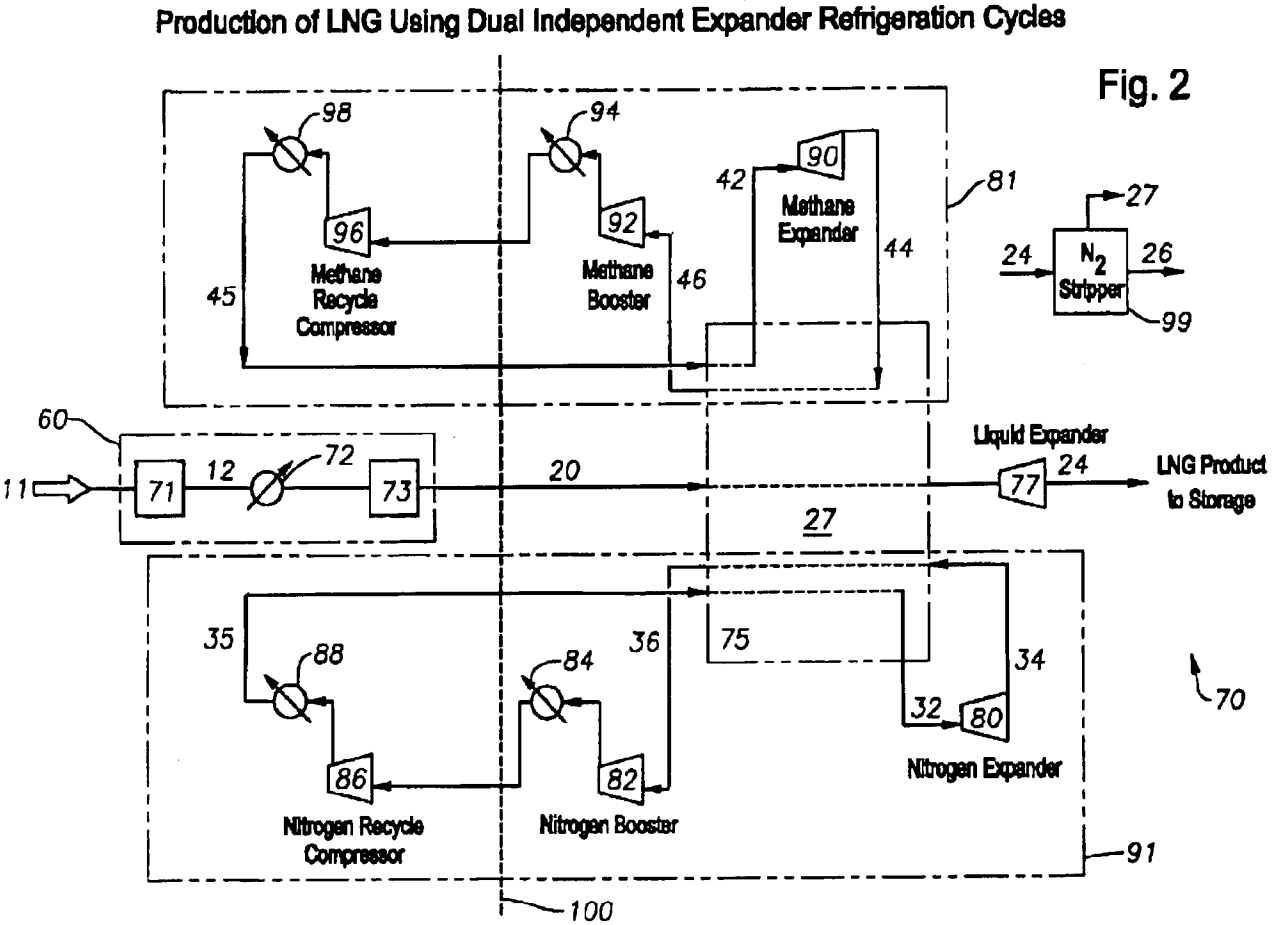
FIG. 2 is a simplified diagram of the turboexpander process used for LNG production in accordance with an embodiment of the present invention, indicating the refrigerant cycle process equipment located on each vessel.

The liquefaction process 70 preferably contains at least one expander 80, 90, at least one booster compressor 82, 92 preferably attached to expander 80, 90, at least one recycle compressor 86, 96, and at least one heat exchanger 27. The liquefaction process 70 utilizes two refrigerant cycles 81, 91, wherein the expansion steps 80, 90 and the booster compression steps 82, 92 of each cycle are located on the second vessel 40, and the recycle compression steps 82, 92, 86, 96 of each cycle are located on the first vessel 30. As shown in FIG. 2, line 100 indicates the point at which the process is split between the two vessels The refrigerants and the treated inlet gas stream 20 are transported between the two vessels 30, 40 by the use of piping 80. Piping 80 includes process streams 20,35, 36, 45, and 46, as shown in FIG. 2. As optionally shown in FIG 1. piping 80 can be supported by a bridge 99 to hold the piping between first and second vessels 30, 40. An LNG storage facility 50 is provided that is preferably mounted on the second vessel 40 to store the LNG. The system can also include an offloading facility 55 preferably mounted on second vessel 40 for unloading the LNG to transport vessels for further use.

Figure 3:
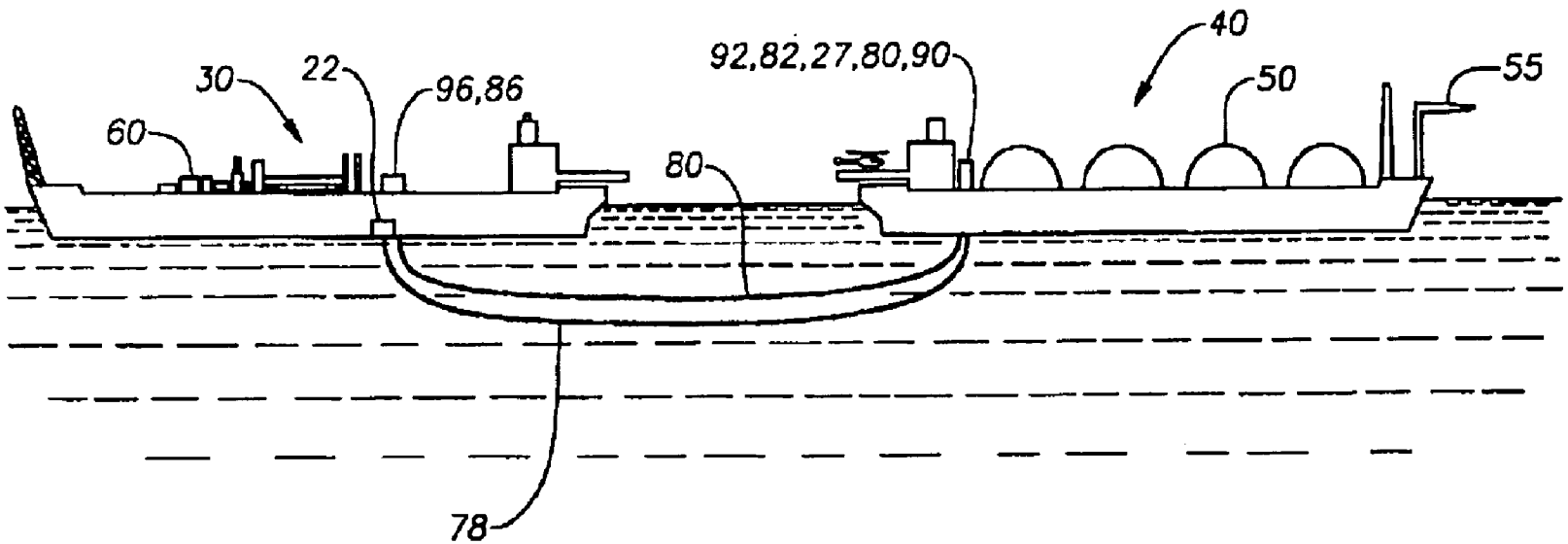
FIG. 3 is a simplified diagram of the stationary nautical vessel offshore LNG production arrangement of another embodiment of the present invention in which electricity is generated on a first vessel and transferred to the second vessel as needed for the compression steps of the refrigeration cycles used to liquefy the treated inlet natural gas stream.

As an alternate embodiment shown in FIG. 3, electrical generation from generators 22, can be produced to provide power for the compression steps 82, 92, 86, 96. Generators 22 can include turbines, engines, or boilers. Generators 22 can be installed upon the vessels or more preferably can be the generators 22 formerly associated with supplying locomotion for the vessel upon which the generator 22 is located. Since the vessels 30, 40 are no longer seaworthy, the generators 22 are no longer needed for locomotion purposes and can be used to provide the electricity needed to run the compressor sections of the refrigerant cycles 81, 91.

In this second embodiment, the inlet gas treatment section 60 is located on the first vessel 30. The treated inlet gas stream 20 can be transported from the first vessel 30 to the second vessel 40 through the use of submerged piping 80. Generators 22 can be located on the first vessel 30, the second vessel 40, or on both. If the generator 22 is only located on the first vessel 30, a cable 78 can be used to transport needed electricity to the second vessel 40. If the generator 22 is only located on the second vessel 40, a cable 78 can also be used to transport needed electricity to the first vessel 30. If generators 22 are located on both vessels 30, 40, then cables 78 for transporting electricity are not needed, but can be included.

Ideally, the electricity is transported between the vessels 30, 40 through the use of a High Voltage Direct Current (HVDC) system 78. New technology in high voltage direct current (HVDC) transmission is preferred to supply energy to the compression train in the liquefaction process 70.

In both embodiments of the present invention, the storage tanks 50 can be membrane or spherical tanks. The vessels 30, 40 can be obtained from spent, non-seaworthy carriers that are retrofitted to remain stationary for the production of LPG and LNG. Modifications can be made to the vessels, as necessary, such as removal of storage tanks 50 for needed equipment space or the addition of platforms to place equipment, if necessary.

The first vessel 30 can be an LPG vessel, an ex-VLCC (Very large Cargo Container), or the like. The ex-VLCC is preferred. The second vessel 40 can be an ex-LNG Carrier or fit for purpose LNG carriers. The primary difference between an LPG vessel and an LNG carrier is the materials of construction for the storage tanks on the vessels. As an alternate to the use of submerged piping 80 between the two vessels 30, 40, it is believed that a bridge 99 could be used between the two vessels 30, 40 for transporting materials between the vessels 30, 40. Piping 80 includes any material appropriate for the purpose, including, for example, flexible or rigid conduit.

Along with the system embodiments, methods of offshore production of liquefied natural gas are advantageously provided. In one embodiment, natural gas is supplied to a front end gas treating process unit 60, which is preferably located on a first vessel 30, to produce a treated inlet gas stream 20. Treated inlet gas stream 20 is transferred to a second vessel 40 where the treated inlet gas stream 20 is cooled to produce a liquefied natural gas stream 24. Liquefied natural gas stream 24 is preferably expanded in liquid expander 77, which is then stored within an LNG storage facility 50 preferably mounted on the second vessel 40. The stored liquefied natural gas can be unloaded from the LNG storage facility to a transport vessel for future use.

In all embodiments of the present invention, the step of cooling the treated inlet gas stream 20 can include cooling at least a portion of the treated inlet gas stream 20 by heat exchange contact with first and second expanded refrigerants. Preferably, at least one of the first and second expanded refrigerants is circulated in a gas phase refrigeration cycle 81, 91. Gas phase refrigeration cycle 81, 91 preferably includes at least one expander step 80, 90, at least one booster compressor step 82, 92, and at least one recycle compressor step 86, 96. The recycle compressor step 86, 96 is preferably performed on the first vessel 30. The expander step 81, 91 and the booster compressor step 82, 92 are preferably performed on the second vessel 40.

As another embodiment of the present invention, a method of offshore production of liquefied natural gas is advantageously provided. This embodiment preferably includes the step of supplying natural gas to a front end gas treating process unit 60, which is preferably located on a first vessel 30 to produce a treated inlet gas stream 20. A generator 22 is used to generate electricity needed to power at least one of the compression steps. As previously indicated, generator 22 can include a turbine, diesel engine, or boiler associated with one or both of the vessels. Generator 22 can also be a newly mounted generator 22. Treated inlet gas stream 20 is transferred to a second vessel 40. Treated inlet gas stream 20 is cooled and then expanded to produce a liquefied natural gas stream 24. Liquefied natural gas stream 24 is then stored within an LNG storage facility 50 preferably mounted on the second vessel 40. The liquefied natural gas stream can be unloaded from the second vessel 40 to a transport vessel for future use.

In all embodiments of the present invention, the nautical vessels 30, 40 will be deployed offshore for the life of the economic exploitation. The first vessel 30, the LPG/FPSO, receives gas from production and processes the gas to obtain byproducts, such as gasoline, LPG mix, or specific products like propane and butane. The gas can also be taken from other sources, such as storage vessels or another production vessel. Other gas supply sources will be known to those skilled in the art.

As an advantage of this invention, the new process and apparatus can be used for gas production of stranded natural gas reserves that might otherwise remain dormant. This invention is particularly advantageous since the costs of this type of production process are significantly reduced since ordinary nautical vessels can be used, as opposed to obtaining a custom-made nautical vessel to hold the floating LNG processing unit. In addition to the cost savings, the lead times are also drastically reduced since the nautical vessels are readily available, instead of having to wait for a custom-made nautical vessel, which typically takes years to fabricate.

Another advantage to this new process and apparatus is the ability to export natural gas to regions of the world that would otherwise not be able to obtain it. This could potentially result in cleaner air and less greenhouse effect globally since more people would have access to this fuel source. This process and apparatus also assure a cost effective way to produce fuel from this fuel source.

While the invention has been shown or described in only some of its forms, it should be apparent to those skilled in the art that it is not so limited, but is susceptible to various changes without departing from the scope of the invention.

For example, various means of nautical vessels can be used to carry the equipment during the gas production. The nautical vessel can be a ship or floating barge or other transportable platform. Equivalent types of vessels will be known to those skilled in the art. As another example, it is envisioned that the process carried on the nautical vessels could be packaged in small modules for the convenience of transportation and installation. This would allow gas producers to rent or lease nautical vessels, as opposed to purchasing their own nautical vessels.

We claim:

1. A system for liquefaction of natural gas offshore comprising:

a first stationary vessel that remains stationary during production of LNG;

a front end gas treating process unit mounted on the first stationary vessel for treating a process stream to produces a treated inlet gas streams;

a second stationary vessel that remains stationary during production of the LNG;

a gas phase refrigerant liquefaction process unit comprising at least one refrigerant expander for expanding at least one gas phase refrigerant stream, at least one booster compressor attached to the expander for compressing the at least one gas phase refrigerant stream, at least one recycle compressor for further compressing the at least one gas phase refrigerant stream, and at least one heat exchanger for liquefying the treated inlet gas stream to produce the LNG, wherein the expander, the booster compressor, and the heat exchanger are mounted on the second stationary vessel and the recycle compressor is mounted on the first stationary vessel for producing the LNG;

an expander for expanding the LNG:

an LNG storage facility mounted on the second stationary vessel to store the LNG; and piping for transporting a treated inlet gas stream between the first stationary vessel and the second stationary vessel an offloading facility mounted on the second stationary vessel for unloading the LNG to transport vessels.

2. A system according to claim 1, wherein the piping for transporting the treated inlet gas stream between the first stationary vessel and the second stationary vessel further includes a bridge to support the piping between the first and second stationary vessels.

3. A system according to claim 1, wherein the first and second stationary vessel comprise non-seaworthy vessel, that remain stationary during production of the LNG.

4. A system according to claim 3, wherein the first stationary vessel is selected from the group consisting of an LPG vessel and an ex-VLCC and the second stationary vessel is selected from the group consisting of an ex-LNG carrier and fit-for purpose LNG carrier.

5. A system according to claim 1, wherein the LNG storage facility comprises at least one storage tank selected from the group consisting of a membrane tank and a spherical tank.

6. A system for liquefaction of natural gas offshore comprising: p1 a first stationary vessel that remains stationary during production of LNG;

a second stationary vessel that remains stationary during production of the LNG;

a front end gas treating process unit mounted on the first vessel for treating an inlet gas stream to produce a treated inlet gas stream;

a generator for generating electricity mounted on a vessel selected flour the group consisting of the first stationary vessel, the second stationary vessel, and combinations thereof;

a gas phase refrigerant liquefaction process unit comprising at least one refrigerant expander for expanding at least one gas phase refrigerant streams at least one booster compressor attached to the expander for compressing the at least one gas phase refrigerant stream, at least one recycle compressor for further compressing the at least one gas phase refrigerant stream, and at least one heat exchanger for liquefying the treated inlet gas stream to produce the LNG, wherein the expander, the booster compressor, and the heat exchanger are mounted on the second stationary vessel and the recycle compressor is mounted on the first stationary vessel for producing LNG, an expander for expanding the LNG;

an LNG storage facility mounted on the second stationary vessel for storing the LNG;

an unloading facility mounted on the second stationary vessel for unloading the LNG; and piping for transporting the treated inlet gas stream between the first stationary vessel and the second stationary vessel.

7. A system according to claim 6, wherein the generator is selected from the group consisting of a turbine, an engine, and a stream boiler.

8. A system according to claim 6, further including a cable for transporting electricity from the first stationary vessel to the second stationary vessel if the generator is located only on the first stationary vessel.

9. A system according to claim 6, further including a cable for transporting electricity from the second stationary vessel to the first stationary vessel if the generator is located only on the second stationary vessel.

10. A system according to claim 6, wherein the piping for transporting a treated inlet gas stream between the first stationary vessel and the second stationary vessel further includes a bridge to support the piping between the first and second stationary vessel.

11. A system according to claim 10, wherein the bridge is used to support the cable between the first and second stationary vessels.

12. A system according to claim 6, wherein the generator for generating electricity comprises a generator capable of providing power for locomotion of the vessel upon which the generator is mounted.

13. A system according to claim 6, wherein the first and second stationary vessel comprises a non-seaworthy vessels that remain stationary during production of the LNG.

14. A system according to claim 6, wherein the first stationary vessel is selected from the group consisting of an LPG vessel and ex-VLCC and the second stationary vessel is selected from the group consisting of an ex-LNG carrier and a fit-for-purpose LNG carrier.

15. A system according to claim 6, wherein the LNG storage facility comprises at least one storage tank selected from the group consisting of a membrane tank and a spherical tank.

16. A method of offshore production of liquefied natural gas comprising the step of:

supplying natural gas to a front end gas treating process unit located on a first stationary vessel to produce a treated inlet gas stream, the first stationary vessel remaining stationary during production of LNG;

transferring the treated inlet gas stream to a second stationary vessel that remains stationary during production of the LNG;

cooling the treated inlet gas stream to produce a liquefied natural gas stream;

expending the liquefied natural gas stream; and storing the liquefied natural gas stream within an LNG storage facility mounted on the second stationary vessel unloading the liquefied natural gas stream from the LNG storage facility to a transport vessel for future use.

17. The method according to claim 16, wherein the step of cooling the treated inlet gas stream includes cooling at least a portion of the treated inlet gas stream by heat exchange contact with first and second expended refrigerants, wherein at least one of the first mid second expanded refrigerants is circulated in a gas phase refrigeration cycle, the gas phase refrigeration cycle comprising at least one compression step.

18. A method of offshore production of liquefied natural gas comprising the steps of:

supplying natural gas to a front end gas treating process unit located on a first stationary vessel to produce a treated inlet gas steam, the first stationary vessel remaining stationary during production of LNG;

generating electricity from a generator mounted on a vessel selected from the group consisting of the first stationary vessel, a second stationary vessel, and combinations thereof;

transferring the treated inlet gas stream to the second stationary vessel that remains stationary during production of the LNG;

cooling the treated inlet gas stream to produce a liquefied natural gas stream;

expanding the liquefied natural gas stream;

storing the liquefied natural gas stream within an LNG storage facility mounted on the second stationary vessel; and unloading the liquefied natural gas stream from the second stationary vessel to a transport vessel.

19. The method according to claim 18, wherein the step of cooling the treated inlet gas stream includes cooling at least a portion of the treated inlet gas stream by heat exchange contact with first ad second expanded refrigerants, wherein at least one of the first and second expanded refrigerants is circulated in a gas phase refrigeration cycle, the gas phase refrigeration cycle comprising at least one compression step.

20. The method according to claim 19, further including providing electricity to provide power to the at least one compression step of the gas phase refrigeration cycle.

21. The method according to claim 18, wherein the step of generating electricity from a generator includes generating electricity from a generator selected from the group consisting of a turbine, an engine, and a steam boiler.

22. The method according to claim 18, wherein the step of generating electricity from a generator includes generating electricity from a vessel turbine used to power for locomotion of the vessel upon which the generator is mounted.

* * * * *

UNITED STATES PATENT AND TRADEMARK OFFICE

CERTIFICATE OF CORRECTION

PATENT NO. : 6,889,522 B2 
DATED : May 10, 2005
INVENTOR(S) : Donald Prible, Robert R. Huebel and Jorge F. Foglietta It is certified that error appears in the above-identified patent and that said Letters Patent is hereby corrected as shown below:

Column 4,
Line 19, remove “not shown” insert -- 99 --.

Column 6,
Line 28, change “produces” to -- produce --.
Line 58, change “vessel” to -- vessels --.

Column 7,
Line 2, remove “P1”.
Line 7, after “first” insert -- stationary --.
Line 7, change “flour” to -- from --.
Line 15, change “streams” to -- streams --.
Line 57, change “vessel” to -- vessels --.
Line 57, change “comprises” to -- comprise --.

Column 8,
Line 2, change “step” to -- steps --.
Line 21, change “mid” to -- and --.
Line 20, change “expended” to -- expanded --.
Line 49, change “ad” to -- and --.

Signed and Sealed this

Eighth Day of November, 2005

JON W. DUDAS
*Director of the United States Patent and Trademark Office*